United States Patent [19]

Kerkhoff et al.

[11] Patent Number: 4,808,267

[45] Date of Patent: Feb. 28, 1989

[54] WATERPROOF PHOTOGRAPHIC PAPER SUPPORT

[75] Inventors: Alois-Bernhard Kerkhoff, Bissendorf; Rudolf Wanka, Osnabrück; Wolfgang Storbeck, Belm, all of Fed. Rep. of Germany

[73] Assignee: Felix Schoeller, Jr. GmbH & Co. KG, Osnabrück, Fed. Rep. of Germany

[21] Appl. No.: 19,580

[22] Filed: Feb. 27, 1987

[30] Foreign Application Priority Data

Mar. 3, 1986 [DE] Fed. Rep. of Germany ..... 3606806

[51] Int. Cl.[4] ..... D21H 1/10; D21H 3/02

[52] U.S. Cl. ..... 162/13; 162/158; 162/164.3; 162/164.6; 162/168.3; 162/179; 162/181.2; 162/181.3; 162/181.5

[58] Field of Search ..... 162/158, 168.3, 179, 162/181.2, 181.3, 181.5, 164.6, 164.3; 430/270, 538

[56] References Cited

U.S. PATENT DOCUMENTS

| | | | |
|---|---|---|---|
| 4,405,408 | 9/1983 | Yoshioka et al. | 162/158 |
| 4,419,433 | 12/1983 | Kubbota et al. | 162/158 |
| 4,517,285 | 5/1985 | Woodward et al. | 162/158 |
| 4,665,014 | 5/1987 | Katsura | 162/158 |

FOREIGN PATENT DOCUMENTS

| | | | |
|---|---|---|---|
| 1110019 | 10/1981 | Canada | 162/168.3 |

*Primary Examiner*—Peter Chin

*Attorney, Agent, or Firm*—Lockwood, Alex, Fitzgibbon & Cummings

[57] ABSTRACT

A waterproof photographic paper support, which is coated with a polyolefin resin, is provided. The paper itself is formed from a particular paper pulp composition which contains fatty acids and/or fatty acid salts and an aluminum salt, as well as, if necessary, alkylketenedimer. Such paper pulp concentration contains, furthermore, anionic and cationic polyacrylamides in the ratio of 40:60 to 60:40, as well as an epoxidized fatty acid amide. The acrylic acid content of the anionic polyacrylamide amounts to between about 5% and 20%.

10 Claims, No Drawings

WATERPROOF PHOTOGRAPHIC PAPER SUPPORT

BACKGROUND AND DESCRIPTION OF THE INVENTION

The invention concerns a photographic paper support, particularly a paper support which is suited for the reception of black-and-white and color photographic layers of the type that require wet development and fixing through photographic processing solutions. Photographic paper supports of this type are distinguished by having a highly smooth surface and a higher internal strength, while exhibiting a slight contamination of the edges during their treatment with the photographic processing solutions.

The use of paper as a support for photographic layers has long been known, and is also advantageous in many respects. The high absorption capacity of paper for photographic processing solutions is, however, disadvantageous. Through new rapid development processes, the washing procedure of the paper support is shortened, and the photographic processing solutions which remain in the paper can, over the course of time or through the effect of heat, form brownish discolorations, which lead to an impairment of the image. The usual coating of the paper support with a polyolefin is known to protect its surfaces, although the edges which are formed by cutting the paper remain unprotected relative to the effect of the photographic processing solutions.

In order to reduce the contamination of the edges, it is known to size the paper with neutral sizing agents such as alkylketenedimers. The use of these neutral sizing agents does not suffice, however, to completely protect the edges of the paper support in rapid development processes. In particular, the permeation of an alcohol such as benzyl alcohol, for example, which is contained in most commercial developers, is not sufficiently impeded.

Different solutions have been proposed to make a paper sized by neutral sizing agents insensitive to the effect of the alcohol by means of further additives. In DOS No. 32 10 621 (U.S. Pat. No. 4,665,014), the use of a combination of alkylketenedimer or another neutral sizing agent, an anionic polyacrylamide, and a cationic starch is described; DOS No. 32 16 841 (U.S. Pat. No. 4,439,496) describes using an internal sizing agent of alkylketenedimer and cationic polyacrylamide; and DOS No. 32 16 840 (U.S. Pat. No. 4,433,030) describes using a combination of an alkylketenedimer and a mixture of anionic and cationic polyacrylamides.

The process described in DOS. No. 32 10 621 does, to be sure, achieve entirely usable results in regard to the contamination of the edges by the photographic processing solutions, but this process disadvantageously impairs the surface materials of the paper. Also, the processes describes in DOS No. 32 16 840 and DOS No. 32 16 841 do not provide an adequately smooth paper surface in order to be suited for a qualitatively high-value image.

By sizing the paper pulp with a known acidic sizing agent, by using fatty acid and/or fatty acid salts and aluminum sulfate, a good surface is indeed obtained; however, the penetration of the photographic processing solutions is not sufficiently impeded, so that the edges of such papers sized with fatty acid and aluminum salts are particularly strongly contaminated.

The object of the invention is thus to create a photographic paper support which is suited for reception of photographic layers, especially black-and-white and colored photographic layers that require a wet development and fixing, and which does not have the disadvantages connected with the state of the art, that is to say, which, after treatment in photographic processing solutions, even when using rapid development processes, has no noteworthy contamination of the edges, and has a highly smooth surface.

The paper support used in accordance with the invention is sized by using fatty acids or fatty acid salts. The fatty acids can be saturated or unsaturated. They contain 14 to 20 carbon atoms and are, for example, palmitic acid, stearic acid, or arachidic acid. Fatty acids with 16 to 18 carbon atoms, particularly stearic acid as well as its salts, such as sodium stearate, are preferred. The addition of the sizing agents to the paper pulp takes place in an acidic pH-range of 3.5 to 5, with the use of aluminum salts, preferably aluminum sulfate or aluminum chloride.

An alkylketenedimer can be added to this sizing mixture of fatty acid and/or fatty acid salt and aluminum salt. The alkylketenedimers used contain alkyl groups with 12 to 18 carbon atoms and can be used individually or in a mixture. In accordance with the invention, an epoxidized fatty acid amide can be added to the paper pulp. The fatty acid groups of the epoxidized fatty acid amide consist of alkyl chains with 14 to 30 carbon atoms.

In a paper pulp which is acidically sized, the ratio of epoxidized fatty acid amide to fatty acid or the fatty acid salt is between about 0.01:1 and 0.2:1. With additional use of alkylketenedimer, the ratio of epoxidized fatty acid amide to alkylketenedimer to fatty acid or fatty acid salt is between about 0.02:0.2:1 and 0.15:0.4:1. The entire quantity of epoxidized fatty acid amide which is added to the sizing mixture used in accordance with the invention amounts to 0.01 to 0.3 weight percent, relative to the paper pulp. If an epoxidized fatty acid amide is added to the paper pulp in quantities below 0.01 weight percent relative to the paper pulp, the penetration of the photographic processing solutions into the paper is not adequately impeded. If the quantity of epoxidized fatty acid amide is increased so as to be in excess of 0.3 weight percent relative to the paper pulp, then the paper loses internal strength, which has a negative effect on its characteristics as a support for photographic layers.

Anionic and cationic polyacrylamides are added to the paper pulp. The ratio of anionic to cationic polyacrylamides is between 40:60 and 60:40, preferably 50:50. The added total quantity is between 0.2 and 2.0 weight percent, preferably between 0.4 and 1.4 weight percent, relative to the paper pulp.

Examples of cationic polyacrylamides which are used in accordance with the invention are products of polyacrylamides modified by Mannich reactions, Hofmann degradation products of polyacrylamides, copolymerization products between acrylamides and ethylenimine, copolymers of acrylamides and a cationic monomer, such as dimethylaminoethylmethacrylate, in the form of the acidic salts of organic or mineral acids, or in quaternized form with methylchloride or dimethylsulfate, or esters, such as, for example, diethylaminoethylacrylester. The molecular weight lies in the range of 500,000 to 2,000,000, preferably from 1,000,000 to 1,500,000.

Anionic polyacrylamides used in accordance with the invention are, for example, partially hydrolized products of polyacrylamides, acrylamide/acrylic acid-copolymers or their salts, (meth)-acrylamide/methacrylic acid-copolymers or their salts, (meth)-acrylamide-(meth)-acrylic acid/acrylnitrile-copolymers or their salts, and (meth)-acrylamide/(meth)-acrylic acid-ester-copolymers or their saponification products. Their molecular weights lie in the range from about 500,000 to about 2,000,000, preferably from about 1,000,000 to 1,500,000.

It has been found that the use of the combination of fatty acids and/or fatty acid salts, aluminum salts, possibly alkylketenedimers, and epoxidized fatty acid amides have particularly favorable effects on the contamination of the edges of the paper by the photographic processing solutions. Opinions heretofore prevalent include the belief that a good internal sizing which protects the paper against the permeation of the photographic processing solutions and which also exhibits a high internal strength of the papers can only be attained by neutral means, that is, with neutral sizing agents in the neutral pH range. Such beliefs have been refuted according to the present invention.

Surprisingly, the further addition of anionic and cationic polyacrylamide effects no strong flocculation of the fibers, but rather achieves a highly smooth surface of the paper with a simultaneously drastic increase in internal strength. The increase in strength is not entirely dependent on the concentrations. Indeed, in general, with all polyacrylamide combinations used, a rise in internal strength is dependent on concentrations; however, this gain in strength varies with the same quantities, the same ratio of quantities, and the same chain lengths of the polyacrylamides.

It has been found that the effects on the internal strength of the paper is, furthermore, dependent on the acrylic acid content of the anionic polyacrylamide which is used. In this context the term acrylic acid refers to free acid groups, partially neutralized acid groups, and completely neutralized acid groups in the anionic polyacrylamide. It has further been found that this is not a matter of a linear dependence; that is, the maximum internal strength is not attained with a high acrylic acid content. It is attained if the acrylic acid content of the anionic polyacrylamide amounts to between about 5 and 20%, preferably approximately 10%. The polyacrylamides used in accordance with the invention can be added as mixtures, or they can be individually added to the paper pulp. The individual addition is particularly preferred.

For use as a photographic support, the paper can be provided, in addition to an internal sizing in the paper pulp, with a surface sizing, which consists, for example, of a starch or polyvinylalcohol coating, which is preferably applied from an aqueous solution in accordance with known application processes onto the paper web. The paper can furthermore, be coated on at least one side with a polyolefin layer which may also contain a light-reflecting white pigment (especially in the front-side coating), as well as color pigments, optical brighteners and/or other additives, such as anti-static compounds, dispersing agents for the white pigment, antioxidants, and the like. The paper itself can contain, in addition to the mixture used in accordance with the invention, mineral or organic filling materials, white pigments, coloring agents or color pigments, optical brighteners, antioxidants and/or other additives which are normal in the production of photographic supports.

The concept in accordance with the invention is elucidated in the following examples.

EXAMPLE 1

A paper having a basis weight of approximately 150 g/m$^2$ was produced from an aqueous pulp slurry (LBKP/NBKP=2/1), to which a sizing mixture having the following compositions were added:

| | |
|---|---|
| Stearic acid: | 1 weight percent |
| Aluminum sulfate: | 2 weight percent |
| Epoxidized fatty acid amide: | 0.15 weight percent |
| Anionic and cationic polyacrylamide in a ratio of 50/50, total quantity: | 1.0 weight percent |

Anionic polyacrylamides with the following acrylic acid contents were employed:

| Sample | Acrylic Acid Content |
|---|---|
| la | 5% |
| lb | 10% |
| lc | 20% |
| ld | 40% |
| le | 60% |

The paper produced from this mixture was extrusion coated on both sides in the normal manner with polyethylene.

EXAMPLE 2

A paper having a basis weight of approximately 150 g/m$^2$ was produced from an aqueous pulp slurry (LBKP/NBKP=2/1), to which a sizing mixture with the following compositions had been added:

| | |
|---|---|
| Stearic acid: | 3 weight percent |
| Aluminum sulfate: | 6 weight percent |
| Alkylketenedimer: | 0.6 weight percent |
| Epoxidized fatty acid amide: | 0.1 weight percent |
| Anionic and cationic polyacrylamide in a ratio of 50/50, total quantity: | 1.0 weight percent |

Anionic polyacrylamides with the following acrylic acid content were employed:

| Sample | Acrylic Acid Content |
|---|---|
| 2a | 5% |
| 2b | 10% |
| 2c | 20% |
| 2d | 40% |
| 2e | 60% |

The paper produced from this mixture was extrusion coated on both sides in the usual manner with polyethylene.

EXAMPLE 3

A paper having a basis weight of approximately 175 g/m$^2$ was produced from an aqueous pulp slurry (LBKP/NBKP=1/1), to which a sizing mixture of the following compositions had been added:

| | |
|---|---|
| Sodium stearate: | 2 weight percent |
| Aluminum trichloride: | 4 weight percent |
| Anionic and cationic polyacrylamide in a ratio of 40/60; acrylic acid content of the anionic polyacrylamide: 10%, total quantity: | 0.3 weight percent |
| Epoxidized fatty acid amide: | |
| Sample | |
| 3a | 0.005 weight percent |
| 3b | 0.01 weight percent |
| 3c | 0.04 weight percent |
| 3d | 0.1 weight percent |
| 3e | 0.3 weight percent |
| 3f | 0.5 weight percent |

The paper produced from this mixture was extrusion coated on both sides with polyethylene in the usual manner.

EXAMPLE 4

A paper having a basis weight of approximately 175 g/m$^2$ was produced from aqueous pulp slurry (LBKP/NBKP=1/1), to which a sizing mixture with the following compositions had been added:

| | |
|---|---|
| Sodium stearate: | 2 weight percent |
| Aluminum trichloride: | 4 weight percent |
| Epoxidized fatty acid amide: | 0.1 weight percent |
| Anionic and cationic polyacrylamide in a ratio of 60/40; Acrylic acid content of the anionic polyacrylamide: 10% in the following total quantities: | |
| Sample | |
| 4a | 0.2 weight percent |
| 4b | 0.4 weight percent |
| 4c | 0.8 weight percent |
| 4d | 1.0 weight percent |
| 4e | 2.0 weight percent |

The paper produced from this mixture was extrusion coated with polyethylene in the usual manner.

EXAMPLE 5

A paper having basis weight of approximately 175 g/m$^2$ was produced from an aqueous pulp slurry (LBKP/NBKP=1/1), to which a sizing mixture with the following compositions had been added:

| | |
|---|---|
| Sample 5a | |
| Sodium stearate: | 1.5 weight percent |
| Aluminum trichloride: | 3 weight percent |
| Alkylketenedimer | 0.6 weight percent |
| Epoxidized fatty acid amide: | 0.22 weight percent |
| Anionic and cationic polyacrylamide in a ratio of 40/60; Acrylic acid content of the anionic polyacrylamide: 10%, total quantity: | 0.4 weight percent |
| Sample 5b | |
| Sodium stearate: | 2 weight percent |
| Aluminum trichloride: | 4 weight percent |
| Alkylketenedimer: | 0.4 weight percent |
| Epoxidized fatty acid amide: | 0.04 weight percent |
| Anionic and cationic polyacrylamide in a ratio of 60/40; | |

-continued

| | |
|---|---|
| Acrylic acid content of the anionic polyacrylamide: 10%, total quantity: | 1.5 weight percent |

The paper produced from this mixture was provided with a surface coating having the following composition:

| | |
|---|---|
| Water: | 1000 g |
| Crotonic acid-modified Polyvinyl alcohol (Saponification degree: 99% Carboxyl group content 3.1 mol %) | 40 g |
| Sodium chloride: | 20 g |

The weight of the coating applied was 2 g/m$^2$. The paper treated was dried and extrusion coating with polyethylene in the usual manner.

EXAMPLE 6 (Comparative Example)

A paper having a basis weight of approximately 170 g/m$^2$ was, in accordance with Example 4 of DOS No. 32 16 840, produced from an aqueous pulp slurry (LBKP/NBKP=2/1), to which a sizing mixture with the following composition had been added:

| | |
|---|---|
| Alkylketenedimer: | 0.4 weight percent |
| Polyamide-polyamine-epichlorohydrine: | 0.5 weight percent |
| Cationic polyacrylamide: | 0.5 weight percent |
| Anionic polyacrylamide: | 0.5 weight percent |

The paper produced from this mixture was extrusion coated on both sides with polyethylene in the usual manner.

EXAMPLE 7 (Comparative Example)

A paper having a basis weight of approximately 170 g/m$^2$ was, in accordance with Example 2 of DOS No. 32 16 841, produced from an aqueous pulp slurry (LBKP/NBKP=1/1), to which a sizing mixture of the following composition had been added:

| | |
|---|---|
| Alkylketenedimer: | 0.7 weight percent |
| Polyamide-polyamide-epichlorohydrine: | 0.5 weight percent |
| Cationic polyacrylamide: | 0.7 weight percent |

The paper produced from this mixture was extrusion coated on both sides with polyethylene in the usual manner.

EXAMPLE 8 (Comparative Example)

A paper having a basis weight of approximately 150 g/m$^2$ was, in accordance with Example 1 of DOS No. 32 10 621, produced from an aqueous pulp slurry, to which a sizing mixture with the following composition had been added:

| | |
|---|---|
| Alkylketenedimer: | 0.5 weight percent |
| Epoxidized fatty acid amide: | 0.3 weight percent |
| Cationic starch: | 2.5 weight percent |
| Anionic polyacrylamide: | 0.3 weight percent |

The paper produced from this mixture was extrusion coated on both sides with polyethylene in the usual manner.

EXAMPLE 9 (Comparative Example)

A paper having a basis weight of approximately 150 g/m$^2$ was produced from an aqueous pulp slurry (LBKP/NBKP=2/1), to which a sizing mixture with the following composition had been added:

| | |
|---|---|
| Sample 9a | |
| Stearic acid: | 1 weight percent |
| Aluminum sulfate: | 2 weight percent |
| Anionic and cationic polyacrylamide in a ratio of 50/50; | |
| Acrylic acid content of the anionic polyacrylamide: | 1.0 weight percent 10%, |
| total quantity: | |
| Sample 9b | |
| Stearic acid: | 1 weight percent |
| Aluminum sulfate: | 2 weight percent |
| Epoxidized fatty acid amide: | 0.15 weight percent |
| Sample 9c | |
| In accordance with 5a, but without the epoxidized fatty acid amide. | |
| Sample 9d | |
| In accordance with 9a, but without any anionic and cationic polyacrylamide. | |

The paper produced from this mixture was extrusion coated with polyethylene in the usual manner.

TESTS OF THE SUPPORT MATERIALS

Both the paper as well as the paper support for photographic layers produced by polyethylene extrusion on both sides were subjected to tests, the results for each sample being reported in the Table.

Test 1: Measurement of Surface Smoothness (Surface Number)

This test was conducted on uncoated paper in accordance with the test method described in the German published patent application No. P 34 26 782.4-52, and the results for each sample are also reported in the Table.

Test 2: Determination of Penetration of the Edges

The paper coated with polyethylene was subjected to a simulated photographic development process with a developer of the type available on the market which contains benzyl alcohol, at a temperature of approximately 30° C. and for a period of 25 minutes. The penetration of the photographic processing solutions into both edges of the test piece was measured by a measuring magnifier. The measuring values for each Sample are stated in the Table as edge penetrations (KE) in mm.

Test 3: Determination of Internal Strength (Internal Bonds)

This test was conducted on paper coated with polyethylene in accordance with method stated in TAPPI RC 308, with the Internal Bond Impact Tester Model B. The measuring values are stated in 1/1000 ft×lb, and the average values of ten measurements for each Sample are reported in the Table.

TABLE

| Sample | Test 1 | Test 2 (mm) | Test 3 (ft × lb) |
|---|---|---|---|
| 1a | 82 | 0.7 | 212 |
| 1b | 79 | 0.7 | 225 |
| 1c | 94 | 0.8 | 209 |
| 1d | 106 | 0.9 | 193 |
| 1e | 118 | 1.2 | 176 |
| 2a | 90 | 0.5 | 248 |
| 2b | 85 | 0.5 | 266 |
| 2c | 101 | 0.6 | 233 |
| 2d | 126 | 0.8 | 207 |
| 2e | 120 | 0.9 | 192 |
| 3a | 191 | 1.3 | 215 |
| 3b | 177 | 1.3 | 209 |
| 3c | 129 | 1.1 | 202 |
| 3d | 98 | 0.9 | 186 |
| 3e | 75 | 0.7 | 108 |
| 3f | 72 | 0.6 | 71 |
| 4a | 92 | 1.0 | 135 |
| 4b | 96 | 0.9 | 176 |
| 4c | 90 | 0.9 | 218 |
| 4d | 94 | 0.8 | 242 |
| 4e | 98 | 0.8 | 266 |
| 5a | 88 | 0.5 | 192 |
| 5b | 94 | 0.5 | 275 |
| 6 | 242 | 0.5 | 282 |
| 7 | 158 | 0.7 | 194 |
| 8 | 276 | 0.5 | 237 |
| 9a | 147 | 1.0 | 271 |
| 9b | 65 | 0.8 | 108 |
| 9c | 168 | 0.6 | 224 |
| 9d | 67 | 0.6 | 112 |

Evaluation of the Results:

Samples 1a through 5b elucidate the effect in accordance with the invention. The test values in column 3 of the Table (Test 3) show that the optimum in relation to the internal strength of the paper lies with an acrylic acid content of the anionic polyacrylamide of 10%. The contrast with the sizing mixtures described in the prior art (Samples 6 through 9d) elucidates the improvement of the surface smoothness which is obtained by using the sizing mixture in accordance with the invention (column 1 of the Table, Test 1). Column 2 of the Table illustrates that, in relation to the sizing by using the sizing mixture in accordance with the invention, no deterioration is detected relative to the sizing mixtures described in the prior art. These data illustrate that, contrary to the expectations in the art prior to the present invention, good sizing can be obtained while using sizing agents other than neutral sizing agents.

It will be understood that the embodiments of the present invention which have been described are merely illustrative of certain applications of the principles of the present invention. Numerous modifications may be made by those skilled in the art without departing from the true spirit and scope of the invention.

The example 1d and 1e as well as 2d and 2e were intended to demonstrate that higher contents of anionic groups than 20% are unsuitable. This was by no means to be expected and is a special surprising feature of the invention.

We claim:

1. A waterproof photographic paper support including paper coated with polyolefin resin, said paper support having been formed from a paper pulp composition comprising:

paper fiber material;

a fatty acid sizing agent selected from the group consisting of a fatty acid and a salt of a fatty acid;

an aluminum salt;

anionic and cationic polyacrylamides having a ratio of anionic polyacrylamide to cationic polyacrylamide of between about 40 to 60 and 60 to 40, said anionic polyacrylamide having an acrylic acid content of between about 5 and 20 weight percent based on the total weight of the anionic polyacrylamide; and an epoxidized fatty acid amide.

2. The waterproof paper support according to claim 1, wherein said paper pulp further includes an alkylketenedimer.

3. The waterproof paper support according to claim 1, wherein said acrylic acid content of the anionic polyacrylamide is approximately 10 weight percent, based on the total weight of the anionic polyacrylamide.

4. The waterproof paper support according to claim 1, wherein said anionic and cationic polyacrylamides are included in the paper pulp composition at a total concentration of between about 0.2 and 2.0 weight percent, based on the weight of said paper fiber material.

5. The waterproof paper support according to claim 1, wherein said anionic and cationic polyacrylamides are included in the paper pulp composition at a total concentration of between about 0.4 and 1.4 weight percent, based on the weight of said paper fiber material.

6. The waterproof paper support according to claim 1, wherein said epoxidized fatty amide is included in the paper pulp composition at a concentration such that the weight ratio of same with said fatty acid sizing agent is between about 0.01 to 1 and 0.2 to 1.

7. The waterproof paper support according to claim 1, wherein said epoxidized fatty amide is included in the paper pulp composition at a concentration of between about 0.01 and about 0.3 weight percent, based on the total weight of said paper fiber material.

8. The waterproof paper support according to claim 6, wherein said epoxidized fatty amide is included in the paper pulp composition at a concentration of between about 0.01 and about 0.3 weight percent, based on the total weight of said paper fiber material.

9. The waterproof paper support according to claim 1, wherein said epoxidized fatty acid amide has an alkyl chain of between about 14 and about 30 carbon atoms.

10. The waterproof paper support according to claim 2, wherein the weight ratio of said epoxidized fatty amide to said alkylketenedimer to said fatty acid sizing agent is between about 0.02 to 0.2 to 1 and about 0.15 to 0.5 to 1.

* * * * *

UNITED STATES PATENT AND TRADEMARK OFFICE

CERTIFICATE OF CORRECTION

PATENT NO. : 4,808,267

DATED : February 28, 1989

INVENTOR(S) : Alois-Bernhard Kerkhoff, Rudolf Wanka and Wolfgang Storbeck

It is certified that error appears in the above-identified patent and that said Letters Patent is hereby corrected as shown below:

Col. 3, line 60, delete comma "," after "furthermore".

Col. 7, line 17, delete "1.0 weight percent" after "Acrylic acid content of the"; line 18, "10%" should immediately follow "polyacrylamide:"; line 19, after "quantity", to the right, insert --1.0 weight percent--.

Col. 8, line 55, "example" should read --examples--.

Signed and Sealed this

Twenty-ninth Day of August, 1989

*Attest:*

*Attesting Officer*

DONALD J. QUIGG

*Commissioner of Patents and Trademarks*